US008170268B2

(12) United States Patent
Weyreuther

(10) Patent No.: US 8,170,268 B2
(45) Date of Patent: May 1, 2012

(54) ELECTRO-DYNAMIC TRANSDUCER WITH A SLIM FORM FACTOR

(75) Inventor: Marcus Michael Weyreuther, Søborg (DK)

(73) Assignee: Bang & Olufsen Icepower A/S GI, Lyngby (DK)

( * ) Notice: Subject to any disclaimer, the term of this patent is extended or adjusted under 35 U.S.C. 154(b) by 702 days.

(21) Appl. No.: 12/292,892

(22) Filed: Nov. 28, 2008

(65) Prior Publication Data

US 2009/0141925 A1 Jun. 4, 2009

(30) Foreign Application Priority Data

Nov. 30, 2007 (DK) ..... 2007 01709

(51) Int. Cl.
*H04R 1/00* (2006.01)

(52) U.S. Cl. ..... 381/400; 381/404; 381/419

(58) Field of Classification Search ..... 381/400, 381/403, 404, 412, 413, 419, 420
See application file for complete search history.

(56) References Cited

U.S. PATENT DOCUMENTS

| | | | | |
|---|---|---|---|---|
| 4,897,877 | A * | 1/1990 | Tetzlaff | 381/302 |
| 5,848,174 | A * | 12/1998 | Ki et al. | 381/404 |
| 6,819,773 | B2 | 11/2004 | D'Hoogh | |
| 2005/0008188 | A1 * | 1/2005 | Harris | 381/404 |

FOREIGN PATENT DOCUMENTS

JP 27-018200 1/1982

* cited by examiner

*Primary Examiner* — Charles Garber
*Assistant Examiner* — Reema Patel
(74) *Attorney, Agent, or Firm* — Harness, Dickey & Pierce, P.L.C.

(57) ABSTRACT

In one embodiment of the present invention, an electro-dynamic transducer is disclosed including a diaphragm, a first suspension suspending the diaphragm, a coil former attached to the diaphragm, the coil former having a first, inner portion, and a second, outer portion, arranged coaxially in relation to each other, a coil arranged around the outer coil former portion, a magnetic system, operable to magnetically cooperate with the coil, and a second suspension mounted between the inner coil former portion and the magnetic system. The new and improved way of placing the second suspension allows for a slim form factor, while stabilizing the system more than prior art designs. The transducer according to one embodiment of the present invention is less sensitive to rocking modes, and the gap in the magnet system can thus be made smaller.

19 Claims, 3 Drawing Sheets

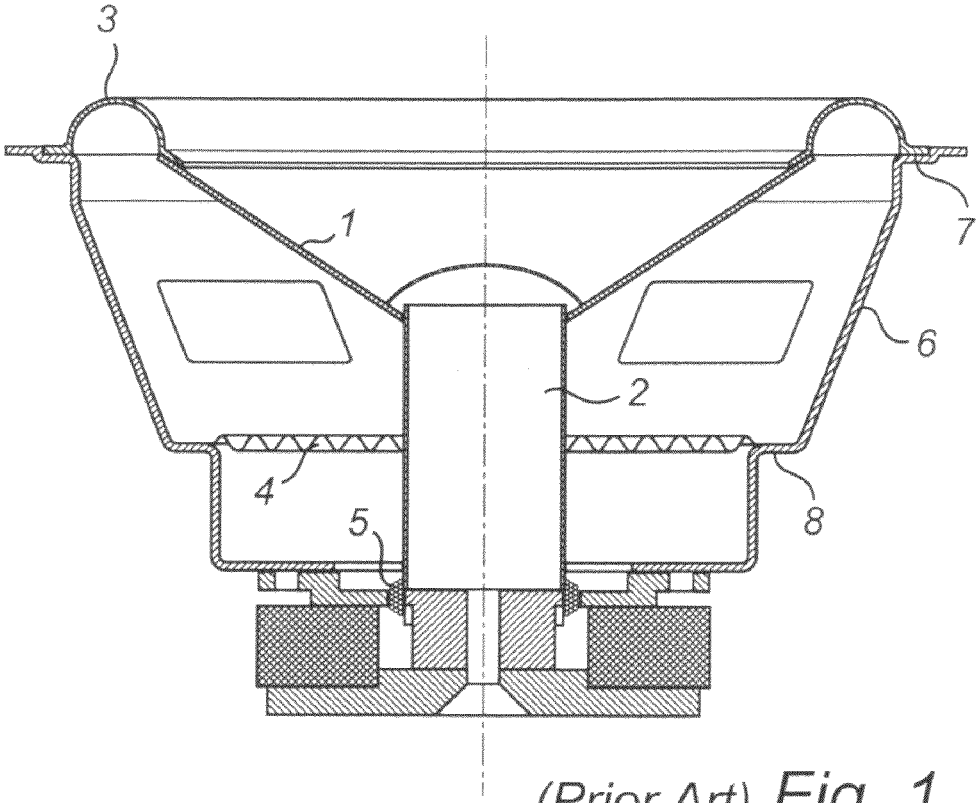
(Prior Art) Fig. 1
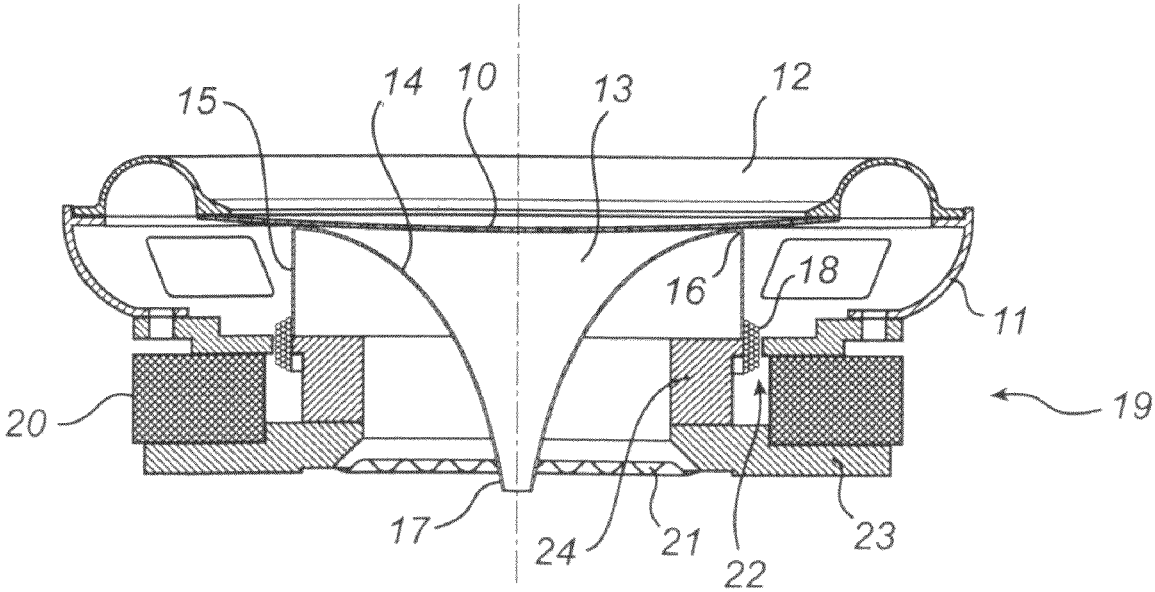
Fig. 2

ELECTRO-DYNAMIC TRANSDUCER WITH A SLIM FORM FACTOR

FIELD OF THE INVENTION

The present invention relates to an electro-dynamic transducer with a slim form factor, i.e. that has a slim design. In particular, the invention relates to a loudspeaker used for applications like Automotive, Televisions, Displays, Flat Speakers, and Walls.

BACKGROUND OF THE INVENTION

A typical transducer architecture of an electro dynamic speaker is shown in FIG. 1. The speaker comprises a diaphragm 1 connected to a voice coil former 2. The diaphragm is suspended by a first suspension 3, and the voice coil former is suspended by a second suspsension 4, also referred to as the spider. A voice coil 5 is arranged around the bottom of the former 2, in the gap of a magnet system. The entire system is embedded in a basket 6, provided with flanges 7, 8 for supporting the suspensions 3, 4.

When an alternating electrical current is brought to flow through the coil 5, a resulting force will move the diaphragm 1 and the former 2. The moving diaphragm moves the air and converts the electrical signal into an acoustical sound pressure waves.

The spider 4 and the suspension 3 form a two point suspension for the motion of the coil 5 and diaphragm 1. The closer these points are to each other, the less stable the system the system becomes to rocking modes. To build a rugged design that is insensitive for rocking modes a large distance of these points is desired. However, the distance between suspension and spider becomes lower with the total height.

Fort his reason, conventional speakers have the disadvantage that they are thick compared to their actual diaphragm displacement. Especially speakers for the low frequency range (woofers) need a strong suspension to provide a large diaphragm displacement without risking too much rocking of the system, and tus become thick. This is of course undesirable for applications like Flat Panel Televisions or placement in a door of a car.

On the other hand, a flat speaker design, with a small distance between the suspension points, will be less stable. This will have negative audible effects and it can even damage the system during operation.

Further, increasing the diameter of the coil has many electrical and thermal advantages to the system. However, increasing the diameter of the coil requires increasing the diameter of the coil former. In a conventional loudspeaker, where the spider is mounted to the peripheri of the coil former, this will result in a reduced effective spider area. A small spider limits the maximum excursion and requires a high force to stretch it. Furthermore it becomes non linear already for small displacements. The result is higher distortion and less sensitivity.

Document U.S. Pat. No. 6,819,773 discloses a speaker where the diaphragm extends through the coil former, and is suspended by the lower suspension (the spider). With this design, the voice coil is arranged between the suspension points, which allows for a slim design with improved stability. Also, the spider is connected to the diaphragm, and will not be affected by an increased coil diameter. However, a drawback with the system in U.S. Pat. No. 6,819,773 is that it requires a specific shape of the diaphragm, restricting the design freedom.

SUMMARY OF THE INVENTION

It is an object of the present invention to provide an improved electro dynamic transducer with satisfactory stability and a low resonance frequency.

According to the present invention, this and other objects are achieved by an electro-dynamic transducer comprising a diaphragm, a first suspension suspending the diaphragm, a coil former attached to the diaphragm, the coil former having a first, inner portion, and a second, outer portion, arranged coaxially in relation to each other, a coil arranged around the outer coil former portion, a magnetic system, operable to magnetically cooperate with the coil, and a second suspension mounted between the inner coil former portion and the magnetic system.

The special shape of the former makes it possible to rearrange the order of the speaker components. In particular, the design of the coil former allows placing the second suspension in the back of the speaker, further away from the diaphragm, without restricting the design of the diaphragm. The second suspension can be mounted directly on the magnet system, and no space requiring components thus need to be placed between diaphragm and magnet system. The maximum static height of the transducer system will be determined by the height of the magnetic system, the absolute maximum displacement of the diaphragm and the height of the diaphragm and its suspension.

The new and improved way of placing the second suspension allows for a slim form factor, while stabilizing the system more than prior art designs. The transducer according to the present invention is less sensitive to rocking modes, and the gap in the magnet system can thus be made smaller.

Also, the present invention enables an increase of the diameter of the voice coil to even the same size like the diaphragm diameter itself, without negative impact on the stiffness or length of the second suspension. The suspension can be soft even for large coil diameter what leads to a low resonance frequency.

Furthermore, compared to conventional designs, the coil former will have a large surface, and thus act as a heat sink, leading to improved thermal capability.

As the second suspension is mounted between the magnet and the coil former, no additional support structure, such as a flange in a speaker enclosure, is required to mount the suspension, leading to a simplified design and lower costs.

In brief, the present invention defines a new principle for transducers which allows reducing the total height of the speaker to reach a maximum-diaphragm-displacement to total-height ratio of approximately one third or even higher. At the same time the system provides automatically a high thermal capability and allows increasing the voice coil diameter even to the same size as the diaphragm itself.

A loudspeaker based on the present invention may advantageously be embedded into a consumer appliance like automotive audio systems, portable audio/video equipment, home audio systems, PC's, Laptops and alike.

The inner coil former portion preferably has a conical shape, with a wide end attached to the diaphragm, and a tapered end at a distance from the diaphragm, and the second suspension can be attached to the tapered end. The conical shape may be advantageous to avoid contact with the magnet system.

It is noted that the invention relates to all possible combinations of features recited in the claims.

BRIEF DESCRIPTION OF THE DRAWINGS

This and other aspects of the present invention will now be described in more detail, with reference to the appended drawings showing currently preferred embodiments of the invention.

FIG. 1 is a cross sectional view of a speaker according to prior art.

FIG. 2 is a cross sectional view of transducer according to a first embodiment of the present invention.

DETAILED DESCRIPTION

Figure 3:
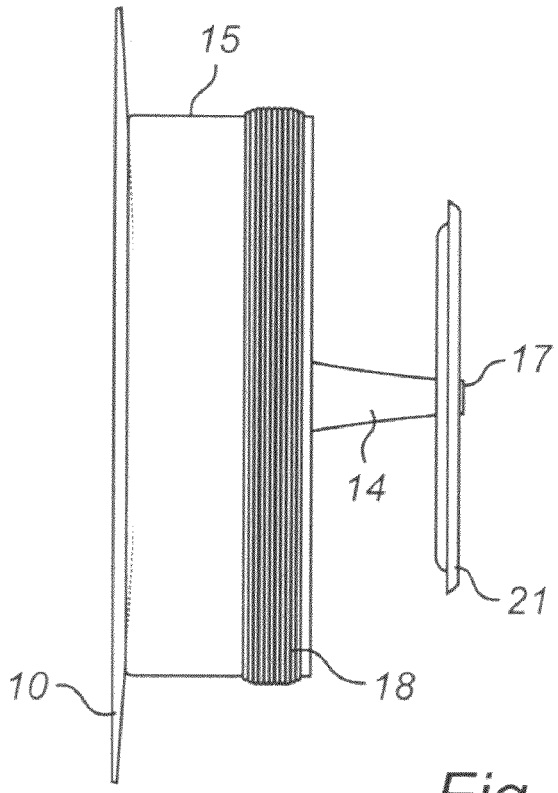
FIG. 3 is a side view of the diaphragm, former and voice coil in FIG. 2.

FIG. 2 shows a schematic cross section of a transducer according to a first embodiment of the invention. A diaphragm 10 is suspended in a basket enclosure 11 by a suspension 12 around its perimeter. The suspension may be e.g. a corrugated rubber annular rim. The back side (facing the interior of the loudspeaker) is attached to a coil former 13.

The coil former has two portions 14 and 15, arranged coaxially in relation to each other. In the illustrated embodiment, the first, inner portion 14 is shaped as a hyperbolic cone, and extends from an annular attachment 16 to the diaphragm to form a tapered end 17 at a distance from the diaphragm. The second, outer portion also extends from the annular attachment 16 and is essentially cylindrical in shape. The length of the inner portion is greater than, here approximately twice, the length of the outer portion.

A coil 18 is arranged around the periphery of the second coil former portion 15, and surrounded by a magnetic system 19, e.g. comprising a permanent magnet 20.

A spider 21 is connected between the inner portion of the coil former and the magnetic system, so as to form a second suspension of the transducer. The spider 21 is connected to a point of the inner coil former portion that is situated further away from the diaphragm compared to the coil 18.

Placing the spider 21 in the back of the magnet leads to the result that the two suspension points 10 and 17 are on the upper and lower edge of the speaker. The distance of these two points is therefore determined by the total height of the speaker and could not be bigger without increasing the total height. This design provides a speaker that is insensitive to rocking modes.

FIG. 3 shows the diaphragm 10, the coil former 13, voice coil 18, and the spider 21 in FIG. 2 in side view. As mentioned above, due to the shape of the coil former 13, the voice coil 18 is now placed between the suspension of the diaphragm 10 and the spider 21. In case of vibrations or rocking on the suspension points, the movement of voice coil 18 itself will be less than the total movement of the suspension. As a result of that, the system stability is high due to the voice coil centering between the two suspension points. Due to that the size of the gap 22 in the magnet system 19 can be reduced, which increases the efficiency and the force factor.

A spider 21 in the back of the magnet structure 19 means that no unnecessary height occupying components are present between diaphragm 10 and magnet 20. That means the diaphragm 10 can move to the back until it reaches the back plate 23 of the magnetic system 19. The maximum static height of the system is therefore only determined be the height of the magnet system 19, the maximum desired displacement of the diaphragm 10, and the height of the diaphragm 10 and its suspension 12.

Another advantage is that the system can easily be scaled up to a larger diaphragm 10 and/or coil 18 diameter without increasing the height. A large voice coil diameter has many advantages. It affects for example the efficiency and the thermal capabilities. A coil 18 with a large diameter can use wires with a larger cross sectional area having a greater current capacity while having the same dc resistance and amount of windings like a coil with a smaller diameter. Therefore the system can handle more power at lower voice coil temperature. Additionally, the area of the coil 18 that is attached to the coil former 13 is bigger, so that the thermal conductance to the coil former 13 is better than it is for smaller diameters. The result is a more powerful system that gains force factor, thermal capability and can handle higher currents.

Increasing the diameter of the coil 18 means increasing the diameter of the outer portion 15 of the former 13, and also the size of the magnetic system. Since the spider 21 is placed between the inner portion 14 of the coil former 13 and the inner edge of the magnet system 19, the effective spider area will actually increase when the coil diameter is increased. As a result, the diameter of the coil former 13 can even be equal with the diaphragm 10 and the suspension 12, 21 becomes even more flexible and more linear for large coil former diameter. The spider behavior is now more linear for small signals.

A better airflow through the system and thereby cooling can be achieved with additional holes in the spider 12 or in the magnet system 19.

Figure 4:
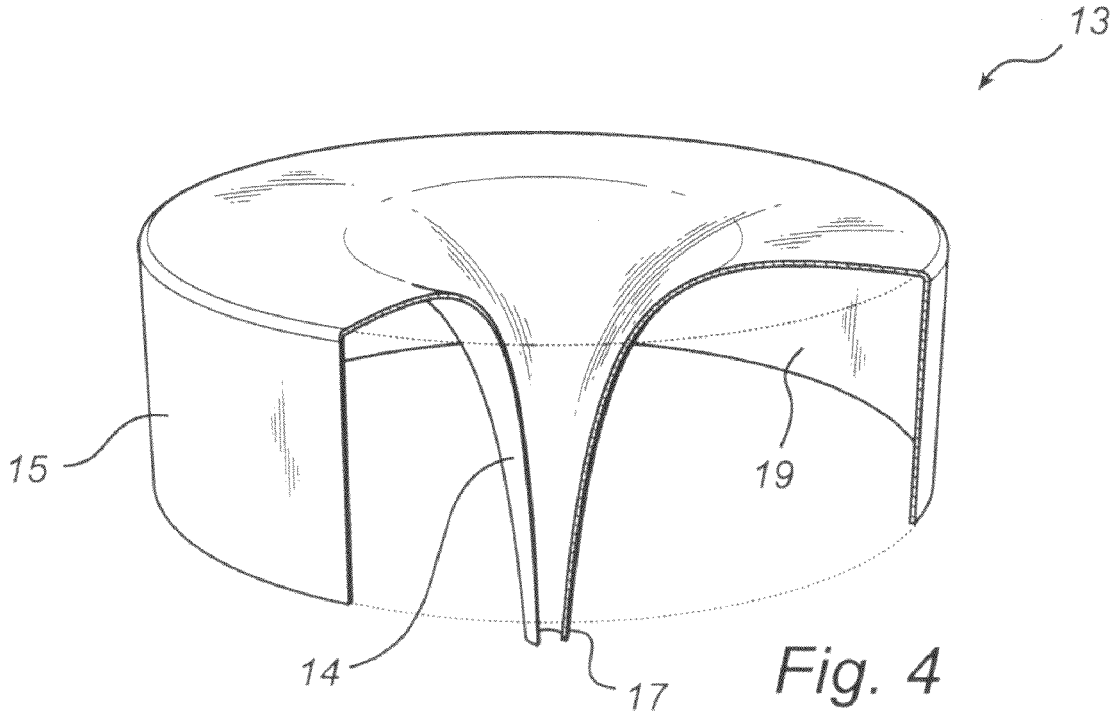
FIG. 4 is a cross sectional view of a further example of a voice coil former according to an embodiment of the present invention.

The illustrated embodiment of the coil former 13 is shown in more detail in FIG. 4. The coil former 13 is here built as one piece, and the outer portion 15 is cylindrical, while the inner portion 14 is shaped as a hyperbolic cone. The diameter of the hyperbolic cone 14 should be as small as mechanically possible on the tapered end 17 to achieve a large spider area. The upper diameter of the coil former, where both portions intersect, defines the diameter of the cylinder portion 15, and is thus determined by the desired diameter of the coil 18.

The hyperbolic cone shape is to prefer instead of a cone with straight sides to reduce the risk that the cone gets in contact with the magnet system 19 during operation. However, it is possible to replace the hyperbolic shape of the inner portion 14 with another shape if it achieves the same result.

Aluminum is to prefer as basic material of the coil former 13 due to its light weight and high thermal conductivity. Other materials like for example titanium, beryllium, magnesium, class fiber or other materials having a high Young Modulus stiffness-density ratio with good thermal conductivity is also feasible. Since this construction also acts like a heat sink, a high thermal conductibility should be given. Furthermore it should have a light total weight to achieve a higher sensitivity and therefore a high sound pressure level. In case of using an electric conductive material like aluminum, a slot inside the cylinder shaped part is required to avoid an electrical shortcut in the magnetic system, 18.

Holes or slots in the hyperbolic cone 14 and cylinder 15 will reduce the weight and ensure airflow from the inside of the speaker to the outside. For these reasons, the tip of the cone should be open too. The holes or slots should not be too small in order to avoid high air velocity and therefore audible air turbulences.

The present invention is especially advantageous for low frequency speaker (woofer) designs, due to the relatively large mass of the coil former 13. It makes it possible to reduce the height of the diaphragm 10 without having a negative impact to the performance if the target is a woofer application.

Even if an extreme slim design could be achieved with an absolute flat diaphragm 10, the requirements on the stiffness of a completely flat diaphragm 10 would lead to a high mass. The high mass of the diaphragm 10 would, in turn, have a negative impact on the sensitivity. Therefore a diaphragm with a large radius may be preferred instead of a flat diaphragm, since it is possible to achieve more stiffness with less material. Furthermore a diaphragm with a larger radius is also less sensitive to break up modes.

It may be advantageous to use aluminum as basic material for the diaphragm 10. An aluminum diaphragm 10 provides a high degree of stiffness and at the same time it will increase the thermal capability of the system, since it is direct attached to the coil former 13 and is therefore a part of the heat sink. Other materials like beryllium or carbon fiber are also conceivable.

Figure 5:
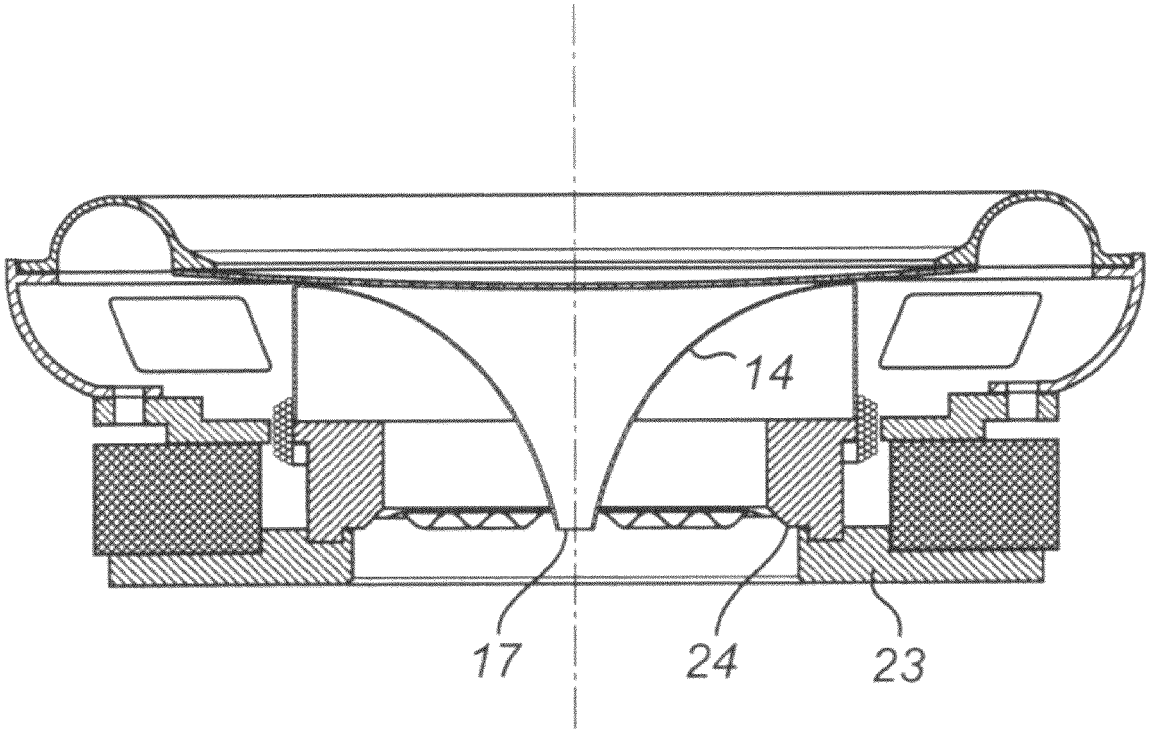
FIG. 5 is a cross sectional view of a transducer according to a second embodiment of the present invention.

As shown in FIG. 5, it is possible to reduce the height of the cone shaped portion 14 and to attach the spider 21 inside the venting passage to back plate 23 or pole piece 24 of the magnet system 19. That reduces the distance between the two suspension points but it allows a design with a reduced dynamic height. Depending on the total dimension, such a design may be advantageous, since it allows decreasing the space behind the driver.

The person skilled in the art realizes that the present invention by no means is limited to the preferred embodiments described above. On the contrary, many modifications and variations are possible within the scope of the appended claims.

For example, the exact architecture of the magnetic system is not relevant for the implementation of the present invention, and the drawings show just a standard magnet system. The person skilled in the art can envisage many other magnet system designs.

The invention claimed is:

1. An electro-dynamic transducer comprising:
a diaphragm,
a first suspension suspending the diaphragm,
a coil former attached to said diaphragm, said coil former having a first, inner portion, and a second, outer portion, arranged coaxially in relation to each other,
a coil arranged around said outer coil former portion,
a magnetic system, operable to magnetically cooperate with said coil, and a second suspension mounted between said inner coil former portion and the magnetic system,
wherein the inner coil former portion has a conical shape, with a wide end attached to the diaphragm, and a tapered end at a distance from the diaphragm, and wherein the second suspension is attached to the tapered end.

2. The electro-dynamic transducer in claim 1, wherein the diaphragm is attached to an upper end of the coil former.

3. The electro-dynamic transducer in claim 1, wherein said coil former is attached to the diaphragm along an annular line of attachments, said line being defined by an intersection between said first and second portions.

4. The electro-dynamic transducer in claim 3, wherein the outer portion extends a shorter distance from the line of attachment than the inner portion.

5. The electro-dynamic transducer in claim 1, wherein the coil former has at least one through hole in its surface.

6. The electro-dynamic transducer in claim 1, wherein the coil former is made of a stiff material with a high thermal capability.

7. The electro-dynamic transducer in claim 6, wherein said material is selected from the group consisting of aluminium, titanium, beryllium, magnesium, class fiber and copper.

8. The electro-dynamic transducer in claim 1, wherein the diaphragm is made of a stiff material with a high thermal capability.

9. The electro-dynamic transducer in claim 8, wherein said material is selected from the group consisting of aluminium, beryllium and titanium.

10. A consumer appliance including an electro-dynamic transducer according to claim 1.

11. An electro-dynamic transducer comprising:
a diaphragm,
a first suspension suspending the diaphragm,
a coil former attached to said diaphragm, said coil former having a first, inner portion, and a second, outer portion, arranged coaxially in relation to each other,
a coil arranged around said outer coil former portion, and
a magnetic system, operable to magnetically cooperate with said coil, and a second suspension mounted between said inner coil former portion and the magnetic system,
wherein said coil former is attached to the diaphragm along an annular line of attachments, said line being defined by an intersection between said first and second portions,
wherein the outer portion extends a shorter distance from the line of attachment than the inner portion.

12. The electro-dynamic transducer in claim 11, wherein the diaphragm is attached to an upper end of the coil former.

13. The electro-dynamic transducer in claim 11, wherein said coil former is attached to the diaphragm along an annular line of attachments, said line being defined by an intersection between said first and second portions.

14. The electro-dynamic transducer in claim 11, wherein the coil former has at least one through hole in its surface.

15. The electro-dynamic transducer in claim 11, wherein the coil former is made of a stiff material with a high thermal capability.

16. The electro-dynamic transducer in claim 15, wherein said material is selected from the group consisting of aluminium, titanium, beryllium, magnesium, class fiber and copper.

17. The electro-dynamic transducer in claim 11, wherein the diaphragm is made of a stiff material with a high thermal capability.

18. The electro-dynamic transducer in claim 17, wherein said material is selected from the group consisting of aluminium, beryllium and titanium.

19. A consumer appliance including an electro-dynamic transducer according to claim 11.

* * * * *